US012516575B2

(12) United States Patent
Löher

(10) Patent No.: US 12,516,575 B2
(45) Date of Patent: Jan. 6, 2026

(54) ROD SECTION SYSTEM

(71) Applicant: TRACTO-TECHNIK GmbH & Co. KG, Lennestadt (DE)

(72) Inventor: Christian Löher, Eslohe (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 0 days.

(21) Appl. No.: 18/421,397

(22) Filed: Jan. 24, 2024

(65) Prior Publication Data

US 2024/0384602 A1 Nov. 21, 2024

(30) Foreign Application Priority Data

Jan. 25, 2023 (EP) ..... 23153271

(51) Int. Cl.
*E21B 7/06* (2006.01)
*E21B 47/024* (2006.01)
*E21B 47/13* (2012.01)

(52) U.S. Cl.
CPC ..... *E21B 7/064* (2013.01); *E21B 47/024* (2013.01); *E21B 47/13* (2020.05)

(58) Field of Classification Search
CPC ..... E21B 7/064; E21B 7/08
See application file for complete search history.

(56) References Cited

U.S. PATENT DOCUMENTS

| | | | | |
|---|---|---|---|---|
| 4,361,192 | A * | 11/1982 | Trowsdale | E21B 7/046 33/312 |
| 5,265,682 | A | 11/1993 | Russell et al. | |
| 8,528,636 | B2 | 9/2013 | Brooks | |
| 9,835,020 | B2 | 12/2017 | Bayliss et al. | |
| 10,544,670 | B2 | 1/2020 | Hay | |
| 2004/0028476 | A1* | 2/2004 | Payne | E21B 44/00 405/184 |
| 2005/0072483 | A1* | 4/2005 | Rioufol | F16L 15/001 138/104 |
| 2011/0284292 | A1 | 11/2011 | Gibb et al. | |
| 2012/0205154 | A1 | 8/2012 | Lozinsky et al. | |
| 2014/0318233 | A1* | 10/2014 | Boike | E21B 7/046 73/152.22 |
| 2016/0290050 | A1* | 10/2016 | Murray | E21B 17/1064 |
| 2020/0080380 | A1* | 3/2020 | Gorrara | E21B 7/04 |
| 2022/0098934 | A1 | 3/2022 | Löher et al. | |

FOREIGN PATENT DOCUMENTS

| | | | |
|---|---|---|---|
| DE | 102020005980 | A1 | 3/2022 |
| EP | 1995406 | A1 | 11/2008 |
| WO | 2012/009375 | A1 | 1/2012 |
| WO | 2012/134468 | A1 | 10/2012 |

* cited by examiner

*Primary Examiner* — Yanick A Akaragwe
(74) *Attorney, Agent, or Firm* — LEASON ELLIS LLP

(57) ABSTRACT

The invention relates to a rod section system for forming an extendable drill string for a ground drilling device, wherein the rod section system has a controllable drill head and rod sections. The controllable drill head has a rotatable drill head tip, wherein a probe is present, which is connected to the drill head tip, and the probe is designed to determine the rolling of the drill head tip, wherein the rod sections are configured for determining a rolling of the rod sections.

1 Claim, 1 Drawing Sheet

ROD SECTION SYSTEM

Figure 1:
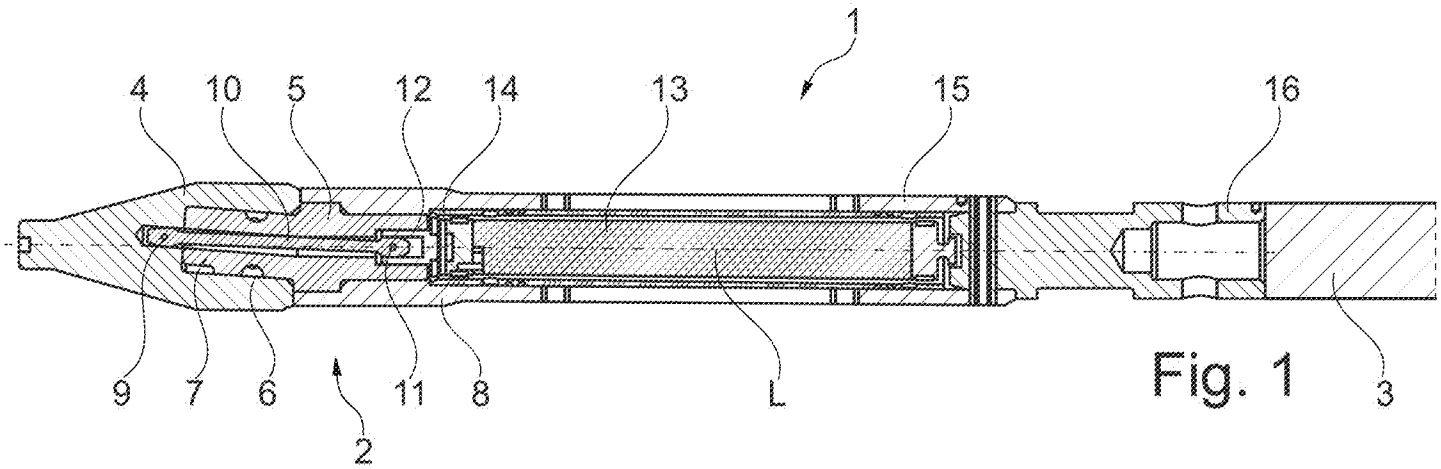

The invention relates to a rod section system for forming an extendable drill string for a ground drilling device and a method for drilling a borehole in the ground with a ground drilling device.

Basically, when drilling in the ground there is a need to direct the drill string located in the ground area to a specific target or to move it along a desired path. The accuracy of the drill string, which is sometimes used in densely built-up areas with extensive infrastructure, especially underground, plays a major role, particularly in horizontal drilling. The drill string must be able to accurately reach an often narrowly delimited target pit in order to bring a ground canal, a line or a cable into a desired position or to allow the drill string to emerge from the surface at a specific point. Ground drilling devices are known which have a controllable drill head for rod-based, directional drilling in the ground. It can be provided that the rod is not constantly rotated about its longitudinal axis for straight drilling. Rather, it can be provided that the rod is only rotated in order to initiate a change of direction. By rotating the rod around its longitudinal axis, a relative (twisting) rotation of a drill head tip relative to the rod can be achieved. The longitudinal axis of the drill head tip can be deflected relative to the longitudinal axis of the rod sections in such a way that the drill head tip, in particular the longitudinal axis of the outer front portion of the drill head tip, is at an angle to the longitudinal axis of the rod sections. If the deflection of the drill head tip in relation to the rod sections is changed, the borehole can be drilled further into the ground with a changed direction. It is possible that if the (twisting) rotation is reversed, the drill string will be then inserted straight in after reversal.

Although good results can be achieved with the known controllable drill heads, it can happen that the rotation applied on the rod does not correspond exactly to the relative rotation of the drill head tip relative to the rod section. This can be the case in particular if a drill head tip is used which is freely rotatable through an angular range in order to adjust the rotation of the drill head tip to the rod in order to achieve the deflection of the drill head tip to the rod sections.

Particularly in systems in which a deviation from straight drilling can be achieved in that the rod can be freely rotated relative to the drill head tip at least over an angular range, for which purpose in particular a jacket friction of the drill head tip with the soil is used, this can lead, if there is insufficient jacket friction between drill head tip and ground, to a deviation from the planned relative rotation of the rod and drill head tip. The angle of rotation set on the rod then does not correspond to the planned, set deflection of the rod to the drill head tip.

It is desirable to increase or ensure the accuracy of the ground bore so that the ground bore can be created along a desired path. If there is a deviation, in particular an indefinite deflection of the drill head tip from the longitudinal axis of the rod, the bore cannot be drilled into the ground precisely enough.

The object is achieved by the subject matter of the independent claims. Advantageous embodiments are the subject matter of the respective dependent claims and result from the following description of the invention.

The invention is based on the idea of increasing the accuracy of the ground drilling by giving the operator a simple means to determine whether the deflection of the drill head tip corresponds to the deflection planned or supposedly set by the operator. From a difference between the planned setting (rolling of the rod) and an actual rolling of the drill head tip, a difference can be determined, which provides the direction in which the rod is inserted into the ground when the borehole is further driven in.

Although a controllable drill head with a drill head tip is used, which does not have to carry out constant movement for straight running, the accuracy of ground drilling can be increased. A simple construction is possible in which the drill head tip can have a bore angled to the longitudinal axis, which can be placed on a support, in particular designed as a receiving bolt. The drill head tip can be arranged on the support, which can also be at an angle with respect to its longitudinal axis. Drill head tip and support can be rotatable relative to each other. It can be provided that the angled components can compensate for each other in a first angular position in such a way that the drill head tip and thus the drill string can run straight (the longitudinal axis of the drill head tip is essentially parallel to the longitudinal axis of the rod sections and/or the drill string or the longitudinal axis of the drill head tip and the longitudinal axis of the rod sections coincide). In a second angular position of the drill head tip and the support relative to one another, the angulations can add up, in particular completely, so that the drill head tip can assume an angled position to the longitudinal axis of the drill string, which can correspond in particular to the addition of the angulations. It is possible to change the course in the second angular position using the drill head tip that can be rotated relative to the support.

Continuous rotation of a consistently outwards asymmetric head tip may be avoided; an asymmetry in the form of an angle of a bore or of a bore perpendicular to the longitudinal axis is "shifted" to the inside of the head tip. In particular, in that (only) two angular positions of the drill head tip relative to the support can be provided, the first angular position can be used for straight drilling and the second angular position can be used for course correction. By means of the invention it is possible to check the setting of the direction. There can be additional benefit for the user in that even with a simply designed and/or small ground drilling device, good accuracy of the planned ground drilling can be possible.

The invention provides a rod section system for forming an extendable drill string for a ground drilling device. The rod section system has a controllable drill head and rod sections. The controllable drill head has a rotary drill head tip. There is a probe connected to the drill head tip, and the probe is designed to determine the rolling of the drill head tip. The rod sections are designed for determining rolling of the rod sections.

For the purposes of the description, the term "drill string" includes a drill head and a string having a rod, which can be moved to drill a bore through the ground using a ground drilling device or a drive device.

In the sense of the description, the term "rod" does not only include rigid, individual rod sections that are directly or indirectly connected to one another. The rod sections can be used as part of the drill string for ground drilling with a ground drilling device. In a preferred embodiment, the rod sections are designed to be rigid. To connect the rod sections to one another and to form at least a part or portion of the drill string, a plug connection of the individual drill string members, which, among other things, includes the drill head and/or probes, which can be arranged in particular in probe housings, is preferably provided. A non-rotatable connection of the rod sections or drill string members is preferred.

The term "rod section" in the sense of the description comprises an element extending along a longitudinal axis, which is part of the rod or drill string for ground drilling. The rod section can be designed as an element arranged on the front of the drill string with an assigned function (probe housing, transmitter housing, or similar) or as an element or drill string member that (merely mechanically) extends the drill string as a rod section. One (through) channel or several (through) channels, for example for drilling fluid, electrical lines, electrical elements and/or electronic elements, can be formed in the rod section. One channel or all of the channels of a rod section can also be designed like a blind bore (a closed end is present). A rod section in the sense of the description can have an outer diameter of 25 mm to 65 mm, preferably 30 mm to 60 mm, preferably 35 mm to 55 mm, preferably 40 mm to 50 mm. A rod section in the sense of the description can have a total length of 450 mm to 650 mm, preferably 500 mm to 600 mm, preferably 520 mm to 580 mm. A rod section in the sense of the description can have a usable length, which takes into account in particular the length of the connecting elements, in particular those provided at the ends, for example, in the case of a plug connection, a length of the connection socket and/or the connection plug. The usable length can result from the total length reduced by the length of the connecting element(s) and be 400 mm to 600 mm, preferably 450 mm to 550 mm, preferably 475 mm to 525 mm. A rod section in the sense of the description can have a groove for engaging an engagement element for moving the drill string, for example a (locking) pawl, which can have an outer diameter of 15 mm to 55 mm, preferably 20 mm to 50 mm, preferably 25 mm up to 45 mm, preferably 30 mm to 40 mm. In a particularly preferred embodiment, the total length of the rod section can be 550 mm and the outer diameter of the rod section can be 45 mm. The usable length of a rod section can be 500 mm. The outer diameter of a groove for engaging an engaging element for moving the drill string may have an outer diameter of 35 mm. The stated values for the outer diameter of the rod section, the (total) length of the rod section, the usable length of the rod section and the outer diameter of a groove on the rod section are not values that limit the dimensions; it should be emphasized that an adaptation to the external conditions, in particular the size of the excavation pit or shaft for the arrangement of the ground drilling device and/or the nature of the soil, can be performed in order to carry out an efficient ground drilling.

In particular, a rod section and/or the drill head can be designed at the end to form at least one plug connection. At one end, the rod section and/or the drill head can have (a) a connection plug with an outer contour or (b) a connection socket with an inner contour. The outer contour or the inner contour can have a cross-sectional shape that deviates from a circle.

If it is described that a connection plug or a connection socket is provided at one end of the rod section, it can be provided that on one and the same rod section there is a connection plug at one end and a connection socket at the other end. It is possible to form a plug connection at both ends of one and the same rod section, wherein the outer contour or the inner contour have a cross-sectional shape that deviates from a circle. However, it is also possible for a rod section according to the invention to have a previously described connection plug with an outer contour or a previously described connection socket with an outer contour only at one end, wherein the other end may have an arbitrary form. A design of a rod section in which only one end has a connection plug or a connection socket with a contour as described allows switching to a different connection system.

In the sense of the description, the term "cross-section" includes a section transverse to the longitudinal axis of the respective element under consideration in the region of the plug connection, in the case of the rod section or the drive element in the end region of the rod section or the drive element, which is provided for the connection to the element to be connected. The cross section is preferably viewed at an angle of 90° to the longitudinal axis. Minor deviations relative to a right angle to the longitudinal axis are possible.

A rod section in the sense of the description can have a connection plug at one end and a connection socket at the other end. This allows a simple connection to be established if the rod sections are in a specific orientation. The inner contour and the outer contour of the connection socket or the connection plug can be aligned with one another in a predetermined angular position, so that the respective contours at the two ends of the rod section are aligned with one another or are aligned in such a way that they can be inserted into one another. However, it can also be provided that the rod section has plug elements of the same shape at the end, so that the rod section has, for example, a connection plug at both ends or a connection socket at both ends, which can have the respective described contour.

For the purposes of the description, a "shape different from a circle" means any geometric shape that does not have a circular shape. The shape, which is a shape that deviates from a circle, does not only contain points of a plane (the cross section that is being considered) that are at a constant distance from a given point on this plane (center). It is possible that the shape, which deviates from a circle, has straight lines at least in sections. The shape can additionally or alternatively have curved or curving lines. As described below, the shape that deviates from a circle can also have a known, easily nameable form.

The shape deviating from a circle can be an oval shape, in particular a rounded convex figure, wherein the figure can especially be an ellipse. The non-circular shape may be an elliptical shape. For the purposes of the description, an ellipse is a closed oval curve that can be represented as a conic section. Typically, an ellipse is a shape with points in which the sum of the distances of a point from two given points, the so-called foci, is the same for all points. Usually, in the case of an ellipse, the straight line through the focal points of the ellipse is called the main axis and the orthogonal straight line through the center of the ellipse is called the minor axis. It can be provided that the, in particular oval, shape, which is in particular designed as an ellipse, is designed such that the shape has no symmetry, which means that the connection plug and connection socket can only be plugged together in an angular position to one another. For example, the ellipse or the elliptical contour, as described above, can have one or more portions that are designed as a straight line.

The term "ground drilling device" in the sense of the description comprises any device which, in particular, can move a drill string having rod sections in a channel in the ground, which is already existing or has to be created, in order to create or widen a bore, in particular a horizontal bore, or pull conduits or other long bodies into the ground. The ground drilling device can be arranged in a construction pit or a shaft, in particular a channel shaft. In particular, the ground drilling device can be designed for a pushing or pressing insertion of the drill string into the ground. An additional pulling method of operation, in which the drill string and/or a duct can be pulled in into the ground after the pushing insertion, in particular up to a target excavation pit, can be provided.

The term "horizontal drilling" in the sense of the present specification encompasses in particular any kind of existing or yet to be created preferably horizontal passages in a body, especially ground passages including earth boreholes, rock boreholes, or earth conduits, as well as underground or aboveground pipelines and water canals which can be produced, spread out or pulled in by using a corresponding ground drilling device.

The term "drill head" in the sense of the description means a portion of the drill string that may form the front end of the drill string. Using a controllable drill head, the operator can influence the direction in which the drill string is inserted into the ground. The drill head has a geometry by means of which an angulation or angle of the drill head relative to the rod sections or the rest of the drill string can be adjusted, which leads to a change in direction of the drill string when the drill string is subject to pressure. The angulation or adjustment of the angle is reversible so that the drill head can be brought back into a position in which straight drilling is possible.

The term "drill head tip" means, as described, a body present at the head of the drill. The drill head tip may be the first element of the drill string on the drill head. The drill head tip can be exposed and, as the first element of the drill string, can be the first to contact the soil when the ground bore is formed by pushing. The drill head tip can have an outer contour that can be completely symmetrical. The outer circumference and the shape of the drill head tip can not only be mirror-symmetrical with respect to a section through a center line, but in particular point-symmetrical. There is preferably no external symmetry that requires constant rotation. The possible adjustment of an angled position of the drill head tip relative to the rod sections can be "shifted" to the inside of the drill head tip.

It can be provided that the drill head tip is arranged on a support. The drill head tip and support can at least partially form the drill head. The support can be at least partially part of the drill head. The support can be formed in and/or on a housing which is arranged in the drill string.

The drill head tip can have a bore that runs obliquely to the longitudinal axis. The support, which is designed, for example, as a receiving bolt, can be at an angle to the longitudinal axis. The drill head tip can be arranged on the support so that it can rotate at least over an angular range, so that the drill head tip and the support can be designed to be rotatable relative to one another. For straight drilling, the drill head tip and the support can be arranged in a first angular position to one another. For drilling that deviates from straight drilling, the drill head tip and the support can be arranged in a second angular position to one another.

The term "support" comprises a structural or machine element which has a bolt-shaped portion, at least in portions, which can be present in particular at the end of the structural or machine element, onto which the drill head tip can be attached. The support can be at an angle with respect to the longitudinal axis, so that the bolt-shaped portion encloses an angle with the longitudinal axis of the support. The angulation of the portion can extend from a center of the support at a predetermined angle.

If it is described that the drill head tip can be rotated relative to the support, it may be preferred to directly attach the drill head tip to the support. However, it can also be provided that an intermediate element is provided between the support and the drill head tip for an indirect connection between the support and the drill head tip. In a preferred embodiment, the axis of a portion of the bore in the drill head tip, into which in particular the support can be inserted, forms an angle with the longitudinal axis of the drill head tip of 1° to 20°, preferably 2° to 15°, preferably 2° to 10°, preferably 2° to 8°, preferably 2° to 6°, preferably 3° to 5°. In a particularly preferred embodiment, the angle of a portion of the bore relative to the longitudinal axis of the drill head tip is approximately 4°. In particular, it can be provided that the bore extends from a centrally arranged opening in the drill head tip into the drill head tip at the aforementioned angle.

In a preferred embodiment, the angulation of the support forms an angle of 1° to 20° with the longitudinal axis of the support. Preferably, the angulation of the support can be an angle of 2° to 15°, more preferably 2° to 10°, more preferably 2° to 8°, more preferably 2° to 6°, more preferably 3° to 5°, relative to the longitudinal axis of the support. In a particularly preferred embodiment, the angulation of the support forms an angle of about 4° with the longitudinal axis of the support. By setting an angle, reference can specifically be made to the extent of the "course correction" and a bore-adapted angle can be set. It can be provided that the angle of the portion of the bore essentially corresponds to the angle of the support.

In a preferred embodiment, the drill head tip has a diameter of less than 70 mm, preferably less than 65 mm, preferably less than 60 mm. In a particularly preferred embodiment, the drill head tip has an outer diameter of 55 mm. Appropriate diameters can be selected for smaller applications, namely for drilling shorter or narrower ground bores. The drill head tip can alternatively or additionally be adapted to the size of the ground drilling device and/or the nature of the soil into which the ground bore is to be drilled. In addition to adjusting an outer diameter, the geometry of the drill head tip can be adapted to the nature of the soil or the material surrounding the bore.

In the sense of the description, the term "probe" comprises an electrical and/or electronic device by means of which rolling around the longitudinal axis can be determined. The rolling can be indicated using an electrical signal. The electrical signal can be generated by the probe. The electrical signal represents the rolling. The probe transmits the rolling, in particular in the form of the electrical signal, preferably wirelessly, namely by radio. However, it can also be provided that the probe transmits the determined rolling via a cable, whereby the cable can be guided through the drill string or the individual rod sections.

In a preferred embodiment, the probe can be designed as an electrical or electronic device which, in addition to rolling, can also locate the drill head.

To evaluate the signals from the probe, a device can be used that indicates to the operator the rolling (time indication and/or graphic representation) and/or the location of the probe.

The term "rolling" in the sense of the description includes the specification of an angle of rotation about the longitudinal axis relative to a reference point, which can be specified as the time indication, for example.

The term "design for determining the rolling of the rod sections" comprises the possibility that the rod sections are designed to be detect a rolling. The rolling can be detected using a marking on the rod sections themselves. It is alternatively or additionally possible for the rod sections to have a shape or contour, in particular at the end, which makes it possible to determine a roll, for example by arranging or connecting an element, for example a tool, in particular in the form of an angle adjuster or rolling adjuster, to a rod section to determine and/or adjust the rolling.

If there is a design in which the rod sections can only be plugged together in a single mutual angular position (e.g. by means of an ellipse with a straight portion), this can also be used to determine the rolling of the rod sections. A marking of the rod sections that is visible from the outside is then not strictly necessary, but can also be present. A corresponding element can be used as a rolling indicator, so to speak, which is designed to complement the end of the rod section and can therefore be plugged to the end of the rod section. A scale or an index can be displayed on the rolling indicator, in order to provide a measure of the rolling, by means of which the amount of rolling can be determined or detected. The statements regarding the element or the rolling indicator also apply to the tool mentioned above, in particular in the form of the angle adjuster or rolling adjuster.

For the purposes of the description, the term "rod section system" comprises several elements of a drill string, wherein the drill head and rod sections are part of the system. Furthermore, a probe is present, in particular in a housing which can be part of the drill string.

The probe can be arranged in a probe housing and/or in a housing for the support. If housings for elements, here in particular probes and/or supports, are described, the term "housing" in the sense of the description comprises an element on and/or in which the probe and/or the support is arranged and/or formed, wherein the housing is designed for connection in the drill string by providing connection elements for connecting to the drill head and/or the rod sections. The probe can in particular be freely rotatable in the probe housing in order to follow the rotation of the drill head tip (rolling) that is to be determined. The probe housing, in turn, can be connected to the rod sections in a rotationally fixed manner.

It can be provided that the probe is connected to the drill head tip with the interposition of a connecting element, which can be designed as a connecting pin. However, it cannot be ruled out that additional connecting elements can be used to connect the probe and the drill head tip. In particular, it can be provided that a non-rotatable connecting element, in particular the connecting pin, is connected directly or indirectly to the drill head tip. The connecting element, in particular the connecting pin, can be connected directly or indirectly to the probe at the end remote from the drill head tip.

For the purposes of the description, the term "having" shall include a non-exhaustive list of elements and/or portions that may be present. There may be more and/or different elements and/or portions than those specified.

In a preferred embodiment, the controllable drill head is designed with a drill head tip and a support that carries the drill head tip. The drill head tip has a bore that runs obliquely to the longitudinal axis and the support has an angle to the longitudinal axis. The drill head tip can be rotated on the support and the drill head tip and the support are arranged in a first angular position to one another for straight drilling, and the drill head tip and the support are arranged in a second angular position to one another for drilling deviating from straight drilling.

In a preferred embodiment, the drill head tip has a diameter of less than 70 mm.

In a preferred embodiment, the outer circumference of the support, which can come into contact with the inner contour of the bore of the drill head tip, or the inner contour of the bore of the drill head tip, which can come into contact with the outer contour of the support, is delimited by or has two stop surfaces. The two stop surfaces are spaced apart from one another in the longitudinal direction of the drill head tip or the support. In each of the two angular positions, one of the stop surfaces of the drill head tip can respectively rest against a stop surface of the support. The stop surfaces can form end positions of a relative rotational movement of the support in the bore. This allows two specific angular positions of the drill head tip to be set relative to the support. The angular positions can be approached precisely and the deflection of the drill head tip relative to the drill string can be used precisely to control the drill head.

In a preferred embodiment, the two stop surfaces are designed relative to one another in such a way that a rotation angle of greater than 45° between the drill head tip and the support can lead to a transfer from the first angular position to the second angular position. In this way it can be achieved that the two angular positions can be intentionally adjusted from one another and that a necessary rotational movement between the two angular positions is sufficiently large to be able to intentionally set one of the two angular positions. Preferably, the angle enclosed between the two stop surfaces may be >50°, further preferred >60°, further preferred >70°, further preferred >80°, further preferred >90°, further preferred >100°, further preferred >110°, further preferred >120°, further preferred >130°, further preferred >140°, further preferred >150°, further preferred >160°, further preferred >170°, in particular 180°. In a particularly preferred embodiment, the two stop surfaces are parallel to one another.

In an embodiment, the support is at least partially surrounded by a wear sleeve, so that a receptacle for the support, in particular at the end, is located in the region of the longitudinal axis, which is congruent with the drill string when the drill head is part of the drill string. All that is required is to replace the wear sleeve if the drill string has been used multiple times. A potentially more complex manufacturing of the support can be postponed by providing the wear sleeve. The wear sleeve can be part of an adapter and/or housing for the support for integrating the controllable drill head on the front side of a drill string. The adapter can have a connecting portion at its end remote from the support, with which the adapter and/or the housing can be attached to a rod section of a drill string. The support can be fixed in the adapter and/or the housing in the wear sleeve by means of a cross bolt so that it cannot rotate, be pulled and displaced.

In a preferred embodiment, the probe is rotatably arranged in a housing and can be rotated together with the drill head tip, so that a particularly simple configuration for determining the rolling of the drill head tip is possible. Due to the forced rotation of the probe together with the drill head tip, it is not necessary to arrange the probe within the drill head tip. Rather, the location for the probe can be moved to a position that is more accessible and/or plannable.

In a preferred embodiment, a connection between the drill head tip and the probe extends through a support for the drill head tip. The support itself can be operatively connected to the rod sections and can be rotated about the longitudinal axis together with the rod sections. A simple design is possible, wherein the support and probe can rotate independently of one another so that the probe can follow the drill head tip.

In a preferred embodiment, there is a passage through the support through which a connecting pin extends, which is connected to the drill head tip and the probe. A simple design is possible.

In a preferred embodiment, the probe has an electrical and/or electronic sensor and a transmission unit which is designed to transmit data from the sensor via radio and/or cable.

In a preferred embodiment, the rod sections have a marking that is visible from the outside.

The invention also provides a method of drilling a ground bore with a ground drilling device, using a drill string having a controllable drill head and drill rod sections to form an extendable drill string. The controllable drill head has a rotatable drill head tip, and the method includes the steps of: determining the rolling of the drill head tip and determining the rolling of the rod sections.

In a preferred embodiment a probe is used which is rotatably arranged in a housing and rotates together with the drill head tip.

In a preferred embodiment, a connection is used, which extends between the drill head tip and the probe through a support for the drill head tip.

In a preferred embodiment, there is a passage through the support through which a connecting pin extends, which is connected to the drill head tip and the probe.

In a preferred embodiment, an electrical and/or electronic sensor is used to determine the rolling of the drill head tip and data from the sensor is transmitted via radio and/or cable.

In a preferred embodiment, a marking on the rod sections that is visible from the outside is used to determine the rolling of the rod sections.

In a preferred embodiment, an engagement for a tool for rotating the rod section about its longitudinal direction is provided at the end of a rod section of the drill string, with which, for example, the rolling can be determined by attaching the tool to the rod section in a position and reading the rolling on a corresponding scale on the tool. In this way, a simple design can be achieved in which the drill string can be rotated about its longitudinal axis in order to rotate the support. The support can be rotated relative to the drill head tip and a corresponding angular position can be set, whereby the rolling can also be determined.

It is also possible, provided that the rod sections can only be plugged together in a single angular position to one another, that the element, in particular in the form of a rolling indicator, or the tool, in particular in the form of an angle adjuster or rolling adjuster, when it is inserted in the end of the rod section, indicates due to its spatial orientation the rolling of the rod section or sections. For example, the element or the tool can have a portion running transversely to the longitudinal axis of the rod section, for example in the form of an arm or lever, the position or angle of which indicates a measure of the rolling.

In a preferred embodiment, a scale is formed on the tool and/or in the area of the drive, by means of which the extent of rotation of the stop surfaces of the support (rolling of the rod sections) about the longitudinal axis can be displayed. The scale may refer to a marking on the rod sections.

The statements regarding the individual aspects of the invention, as described in particular for the controllable drill head and the method, are to be understood as statements that complement one another. Statements regarding one aspect also apply to statements on one of the other aspects.

Numerical information in the sense of the description is information that can have a tolerance of +/−10%, so that the numerical information describes not just one value, but a range of values, in particular to take into account tolerance ranges that may be due to manufacturing.

The above statements, like the following description of exemplary embodiments, do not represent an omission of certain embodiments or features.

In the following, the invention will be explained in greater detail with reference to an exemplary embodiment illustrated in the drawings.

IN THE DRAWINGS

Figure 2:
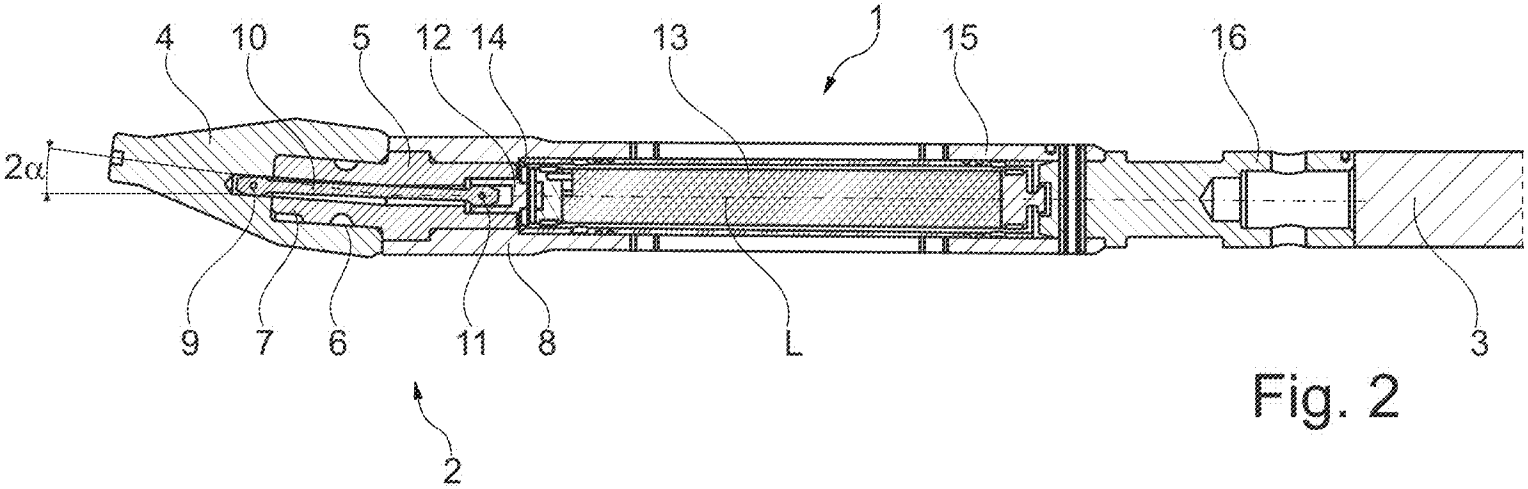

FIG. 1 shows a partially sectioned view of a front portion of a drill string, with the drill head tip and support being in a first angular position to one another; and FIG. 2 shows the representation of FIG. 1, wherein the drill head tip and support are in a second angular position to one another.

FIG. 1 shows a front portion of a drill string 1. The drill string 1 has a controllable drill head 2 and at least one rod section 3. The drill head 2 has a drill head tip 4 and a support 5.

FIG. 1 shows the drill head 2 in a state in which the drill string 1 can be inserted along a straight line. The drill head tip 4 arranged on the front of the drill head 2 forms an extension of the drill string with regard to its outer contour. There is no angle of the drill head tip 4 of the drill head 2 relative to the longitudinal axis of the drill string 1 or the rod sections 3.

The drill head tip 4 of the drill head 2 has a bore 6 which is angled by a relative to the longitudinal axis X-X and which is not round over the entire circumference along a portion of its length. By means of the bore 6, the drill head tip 4 can be plugged onto the support 5 and is rotatably mounted on the support 5 relative thereto. The support 5 can be rotated relative to the drill head tip 4.

The drill head tip 4 is secured to the support 5 in the longitudinal axial direction by means of securing bolts, not shown, which can engage in a recess. In the embodiment shown, the support 5 also has an angle of a relative to the longitudinal axis L, so that the front of the support 5 forms an angle relative to the region 7 of the support 5, which is aligned with the longitudinal axis L of the drill string 1.

In the position shown in FIG. 1, the angulations of the bore 6 of the drill head tip 4 and the support 5 are in a congruent angular position, so that the angular deviations a compensate each other. The drill head tip 4 is therefore in an angular position or location that is suitable for a straight bore drilling.

The support 5 is guided at its rear end into an adapter or support housing 8 and connected thereto in a rotational, pulling and displacement resistant manner via a cross bolt.

In the exemplary embodiment shown, the drill head tip 4 is connected to a probe 13 by means of a connecting pin 10 or piece, wherein a (transmitter) adapter 12 is interposed in this exemplary embodiment. In the exemplary embodiment shown, the connecting pin 10 has a dowel pin 9 between the connecting pin 10 and the drill head tip 4. To connect to the (transmitter) adapter 12, the connecting pin 10 in the illustrated exemplary embodiment is in turn connected to the (transmitter) adapter 12 with a dowel pin 11.

The (transmitter) adapter 12 is connected on the other side to a probe 13 by means of a dowel pin 14. The probe 13 can rotate together with the drill head tip 4 in a probe housing 15, which at least partially accommodates and surrounds the probe 13.

Rod sections 3 can be connected at the end to the end remote from the drill head tip 4 by means of a rod connection 16. The connection between the probe housing 15 and the rod sections 3 is non-rotatable and takes place in a predetermined angular position, so that the (angular) position of the probe housing 15 can be further specified with each rod section 3, provided that the rod sections 3 have a corresponding marking that is visible to the outside.

The marking on the rod sections 3 is present at the ends of the rod sections in the form of a scale that indicates the time or a rolling angle.

The probe 13 in the representation of the exemplary embodiment of FIG. 1 is arranged in such a way that a difference of 180° (6 hours) relative to the angular position of rod sections 3 is present on a device which can indicate the rolling. The 180° are chosen so that there is a 180° angle between the stop surfaces of the support 5 for the drill head tip 4; the angle difference corresponds to the angle between the two stop surfaces.

FIG. 2 shows the front drill string 1 from FIG. 1 in a position or (second) angular position of the drill head tip 4 and support 5 to one another. The second angular position is suitable for imposing a curved path on the course of the bore, for example in order to make corrections to the course of the bore and thus achieve a predefined target.

To adjust the second angular position, the support 5, which has a second stop edge or stop surface in a portion of its length relative to a first stop surface or stop edge, is rotated relative to the drill head tip 4, wherein the soil holds the drill head tip 4 in position by means of jacket friction. As a result, the support 5 comes into contact with its second stop edge or stop surface with the stop edge of the bore 6 of the drill head tip 4. The entire drill string 1 including the drill head tip 4 can be rotated in the intended direction for course correction via the stop edges or stop surfaces. The respective angulations of a add up to form an angle of the drill head tip 4 equivalent to a total of 2*a*, which is shown in FIG. 2. The angulations of the bore 6 of the drill head tip 4 and the support 5 have been brought into opposite angular positions compared to the position shown in FIG. 1.

The rotation of the support 5 is achieved by attaching a rotary adapter with a ratchet attachment to the rear rod section 3, which is yet to be inserted. By rotating the entire rod sections 3 and the components connected thereto in a rotationally fixed manner by 180°, as described above with reference to the rod connection 16, the probe housing 15, the support housing 8 and the support 5, the drill string 1 is rotated, with the drill head tip 4 together with the probe 13 is prevented from rotating by the surrounding soil.

If the probe housing 15 is rotated by means of the rod sections 3 and the drill head tip 4 is held by friction, only the probe housing 15 rotates accordingly. The drill head tip 4 and the probe 13 do not rotate and a noticeable angular deviation of 180° which was previously set, is removed so that a value of the rolling which can be read on the rod section 3 is identical to the displayed rolling of the drill head tip 4 or the probe 13. The operator then knows that the drill head tip 4 is in the second angular position and therefore is deflected by control.

If the operator wants to cancel the control function, he turns the rod sections 3 and thus the probe housing 15 counterclockwise. After a 180° rotation, the angular position of FIG. 1 is reached again. A 180° difference (6 hours) can be seen on the rod sections 3 compared to the rolling of the probe 15. The operator therefore knows that he is now back in the angular position of FIG. 1 and straight drilling is set.

The invention claimed is:

1. A rod section system for forming an extendable drill string (1) for a ground drilling device, wherein the rod section system comprises:

a controllable drill head (2); and rod sections (3), wherein the controllable drill head (2) has a rotatable drill head tip (4), wherein a probe (13) is present, which is connected to the drill head tip (4), and the probe (13) is configured to determine a rolling of the drill head tip (4), wherein the rolling is a specification of an angle of rotation of the drill head tip (4) about a longitudinal axis relative to a reference point, wherein the rod sections (3) comprise an end-side shape or a contour for determining the rolling of the rod sections (3), a) in which an element forming a rolling indicator, angle adjuster or rolling adjuster is arranged on a rod section or connected thereto in order to determine the rolling of the rod sections, or b) into which a drive with a scale engages, by means of which the rolling of the rod sections is displayed, wherein the rod sections are freely rotatable relative to the drill head tip at least over an angular range.

* * * * *